United States Patent [19]

Haack

[11] 3,957,593

[45] May 18, 1976

[54] METHOD OF FORMING AN ABRASIVE TOOL

[75] Inventor: William M. Haack, St. Louis, Mo.

[73] Assignee: Keene Corporation, New York, N.Y.

[22] Filed: Jan. 31, 1975

[21] Appl. No.: 545,984

[52] U.S. Cl. ..... 204/16; 204/25

[51] Int. Cl.[2] ..... C25D 5/02; C25D 7/04

[58] Field of Search ..... 204/16, 23, 25, 40

[56] References Cited

UNITED STATES PATENTS

| | | | |
|---|---|---|---|
| 2,391,206 | 12/1945 | Van Der Pyl | 204/16 |
| 2,858,256 | 10/1958 | Fahnoe et al. | 204/16 |
| 3,046,204 | 7/1962 | Barron | 204/16 |

FOREIGN PATENTS OR APPLICATIONS

| | | | |
|---|---|---|---|
| 1,048,934 | 11/1966 | United Kingdom | 204/16 |
| 966,604 | 8/1964 | United Kingdom | 204/16 |

*Primary Examiner*—T. M. Tufariello
*Attorney, Agent, or Firm*—Kane, Dalsimer, Kane, Sullivan and Kurucz

[57] ABSTRACT

An improved abrasive tool useful in grinding and cutting and an improvement method and apparatus for making the same wherein a blank having a metallic working area presenting the required profile configuration of the tool has a multiplicity of closely spaced abrasive particles of predetermined size, uniformly distributed in a layer of substantially single particle thickness over the working area, and held in place by electro-deposited nickel preferably formed in two layers adhered to the working surface and to the sides of the abrasive particles for approximately ½ to ⅔ of the height thereof. The upper surface of the particles are free from plating material and project above the surface of the plating material between the particles. In applying the abrasive particles, the blank is supported by a fixture in a container having a cylindrical impervious side wall surrounding the working surface in spaced relation thereto and having a porous mesh base portion beneath the working surface. A mass of abrasive particles is packed in the space between the working surface and side wall enclosure and a nickel plating solution is poured downwardly over the working surface and through the abrasive particles and mesh in the presence of a nickel anode to lightly secure or tack the first layer of abrasive particles to the working surface by a thin layer of nickel plating. The surplus abrasive particles outside of the said first layer are then removed and thereafter further nickel plating is applied to firmly secure the first layer of abrasive particles in place.

4 Claims, 6 Drawing Figures

METHOD OF FORMING AN ABRASIVE TOOL

BACKGROUND OF THE INVENTION

Abrasive tools such as grinding wheels useful in grinding the teeth of saw blades have been made by adhering diamond or borazon particles to the working surface area of the tool by means of an adherent matrix formed of resins, vitreous materials, sintered metals, vapor deposited metals, and electro-deposited metals or electroplating.

For many purposes electroplating, particularly electrodeposited nickel, has been the most satisfactory matrix for securing the abrasive particles to the working area of the tool blank. However, the abrasive tools heretofore available having electrically deposited matrices have had recognized disadvantages. Thus, problems were encountered with peeling of the plating from the tool blank. At times the tool life was unduly short due to over plating. Where the tool was under plated the abrasive particles would be stripped from the tool and the tool blank was frequently damaged. Also there was a tendency to obtain "grooving" in the abrasive coating and, in addition, lack of uniformity in the concentration of the abrasive particles — both of which produced undesirable results and lack of uniformity and departure from tolerances in the products produced by the grinding tool. Difficulty was also encountered in bringing and holding the abrasive particles into contact with the working area surface during the plating operation and cumbersome and unsatisfactory expedients were resorted to in attempting to overcome this problem.

SUMMARY OF THE INVENTION

I have found that the problems heretofore encountered can be overcome and improved results can be obtained by utilizing abrasive particles of predetermined size, i.e. between 0.005 inch and 0.009 inch (preferably 0.007 inch) in cross-sectional dimension, then bringing a mass of the particles into contact with the working area surface of the tool blank and lightly securing or tacking the particles to the working surface in a layer of single particle thickness by electro-deposited nickel of a thickness no greater than approximately ⅓ the height of the particles. The surplus abrasive particles are then removed from the area and further nickel plating is applied to a thickness of between ½ and ⅔ of the height of the abrasive particles. During the initial plating or tacking the tool is held in place in a container having an impervious side wall surrounding and spaced from the working surface and having a base with a porous mesh portion having openings smaller than the abrasive particles beneath the space between the side walls and the working area surface. A nickel anode is supported inside the container spaced from the working surface. The abrasive particles are packed in the space between the side walls and working surface with particles in uniform contact with the working area surface, and nickel plating solution is then poured downwardly over the working area surface, through the abrasive particles and porous mesh until a layer of particles of single particle thickness is lightly tacked in place.

By means of my invention the problems heretofore encountered have been overcome and an improved abrasive tool and method and apparatus for making the same are provided wherein the plating remains securely adhered to the tool blank working surface and the abrasive particles are held firmly in place; in which uniform concentration of the abrasive particles and control of tolerances is readily obtained; wherein the problem of grooving is overcome; and in which the abrasive particles are brought into contact with the working area surface during the plating operation. My invention also provides an improved method and apparatus for providing an abrasive particle layer of single particle thickness.

DETAILED DESCRIPTION

My invention is applicable to any abrasive tool having a working area surface on which it is desired to apply abrasive particles so that the tool can be used in various grinding, forming and finishing operations. One type of tool to which my invention is applicable is a grinding wheel for use in grinding the teeth on saws of various types, including band saws.

Figure 1:
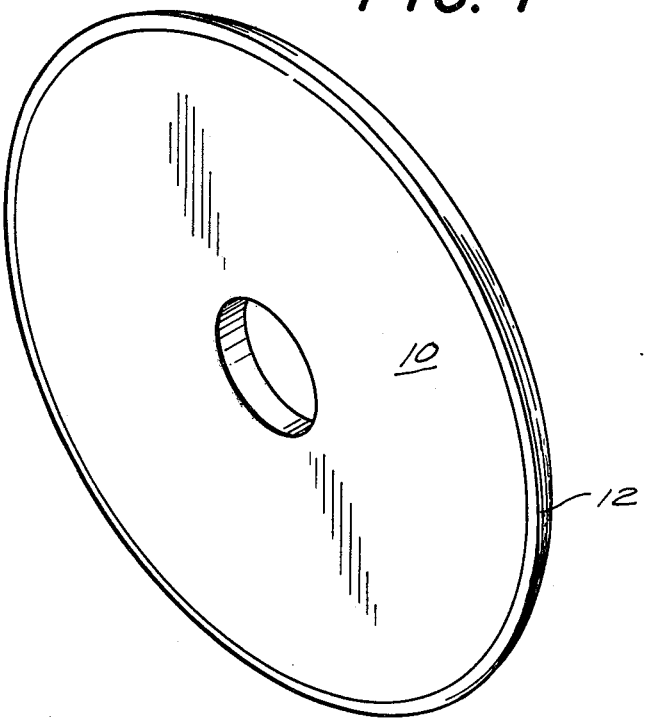
FIG. 1 is a perspective view of an abrasive tool, specifically a grinding wheel embodying my invention.
Figure 3:
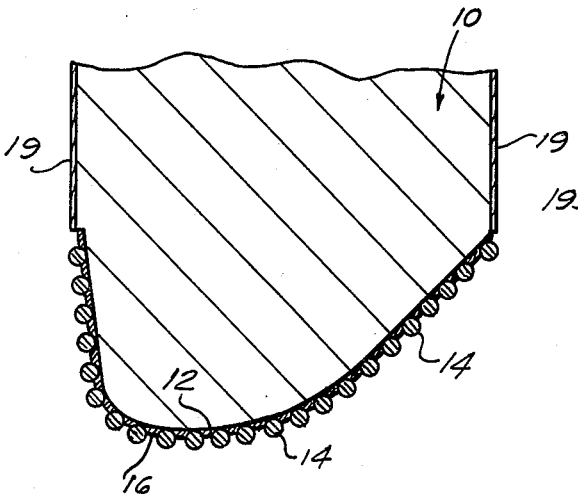
FIG. 3 is an enlarged detailed sectional view showing the working area surface of the grinding wheel and adjacent portions thereof showing a layer of abrasive particles of single particle thickness applied to the working area surface with the initial or "tack" coat of nickel plating.

For purposes of illustration, a grinding wheel of this type has been shown in the accompanying drawings. Thus, in FIG. 1 I have shown a grinding wheel having a disc-shaped body 10 made of a suitable material such as a metal, specifically steel, having a central mounting aperture and a peripheral working surface 12 to which suitable abrasive particles 14 are applied as by nickel plating, as more specifically shown in FIGS. 3 and 4.

Figure 4:
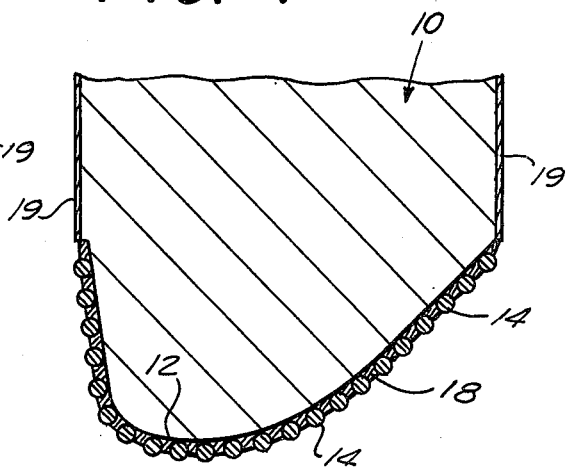
FIG. 4 is a detailed sectional view similar to FIG. 3 showing the abrasive particles applied to the working area surface after the final nickel plating layer has been applied thereto.

The abrasive particles are secured in place by a matrix of a suitable electrodeposited metal, such as electrodeposited nickel, as shown at 18 in FIG. 4 forming a plated coating adhering to the working area surface of the grinding wheel and to the sides of the abrasive particles.

The density of the abrasive particles may vary considerably from a closely spaced substantially contiguous relationship to a spacing between the adjacent particles equal to several times the diameter thereof. It is desirable, however, that the spacing be substantially uniform, particularly in a direction transversely of the working area surface, i.e. transversely of the direction of rotation of the grinding wheel.

I have also found that the particles should be arranged in a layer of single particle thickness and not piled on top of each other and that the particles preferably should be of substantially uniform size. This helps the operator to control more uniformly the work being performed by the abrasive tool and in maintaining close tolerances.

I have also found that the single layer thickness also provides longer tool life.

The size of the particles is also significant and I have found that the best results are obtained when the particle size is between approximately 0.005 inch and 0.009 inch — preferably 0.007 inch.

The preferred abrasive materials are borazon and natural and synthetic diamonds. By borazon, I mean cubic boron nitride crystals which are well known and are available commercially.

As previously stated, the abrasive particles are secured to the working area surface of the tool by metal plating, i.e. electrodeposited nickel. The metal plating is adhered to the working area surface of the tool and to the sides of the abrasive particles to a height of between approximately ½ and ⅔ of the height of the particles. I have found that this provides adequate support for the particles to retain them in place for a prolonged effective life during normal usage while leaving a sufficient amount of the upper portion of the particles exposed above the upper surface of the plating to insure good abrasive action.

Figure 5:
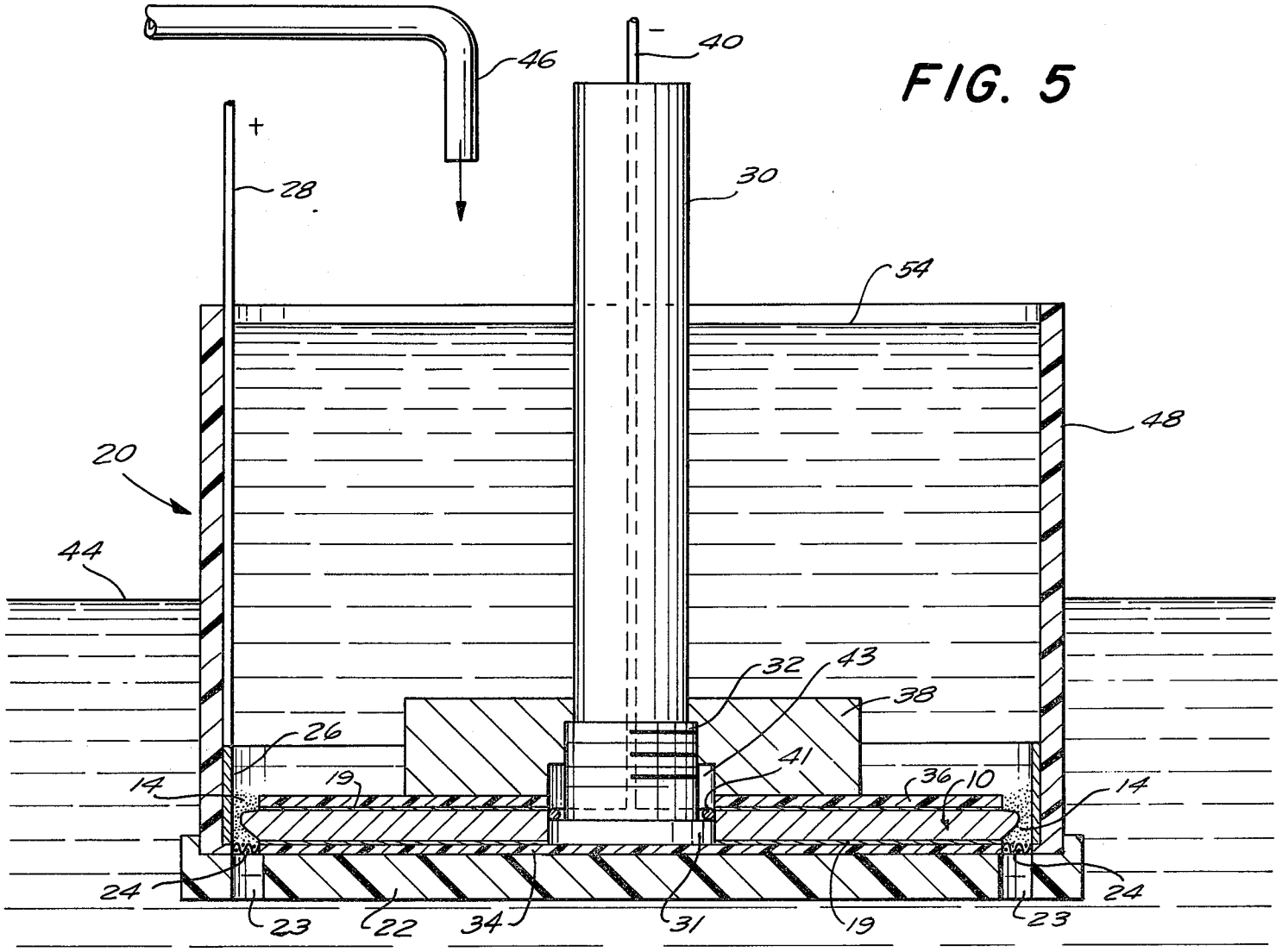
FIG. 5 is a sectional view in elevation of a plating apparatus assembly embodying my invention, including the grinding wheel and supporting fixture for use in applying a layer of abrasive particles of single layer thickness to the working area surface of the grinding tool by means of the initial or tacking coat.
Figure 6:
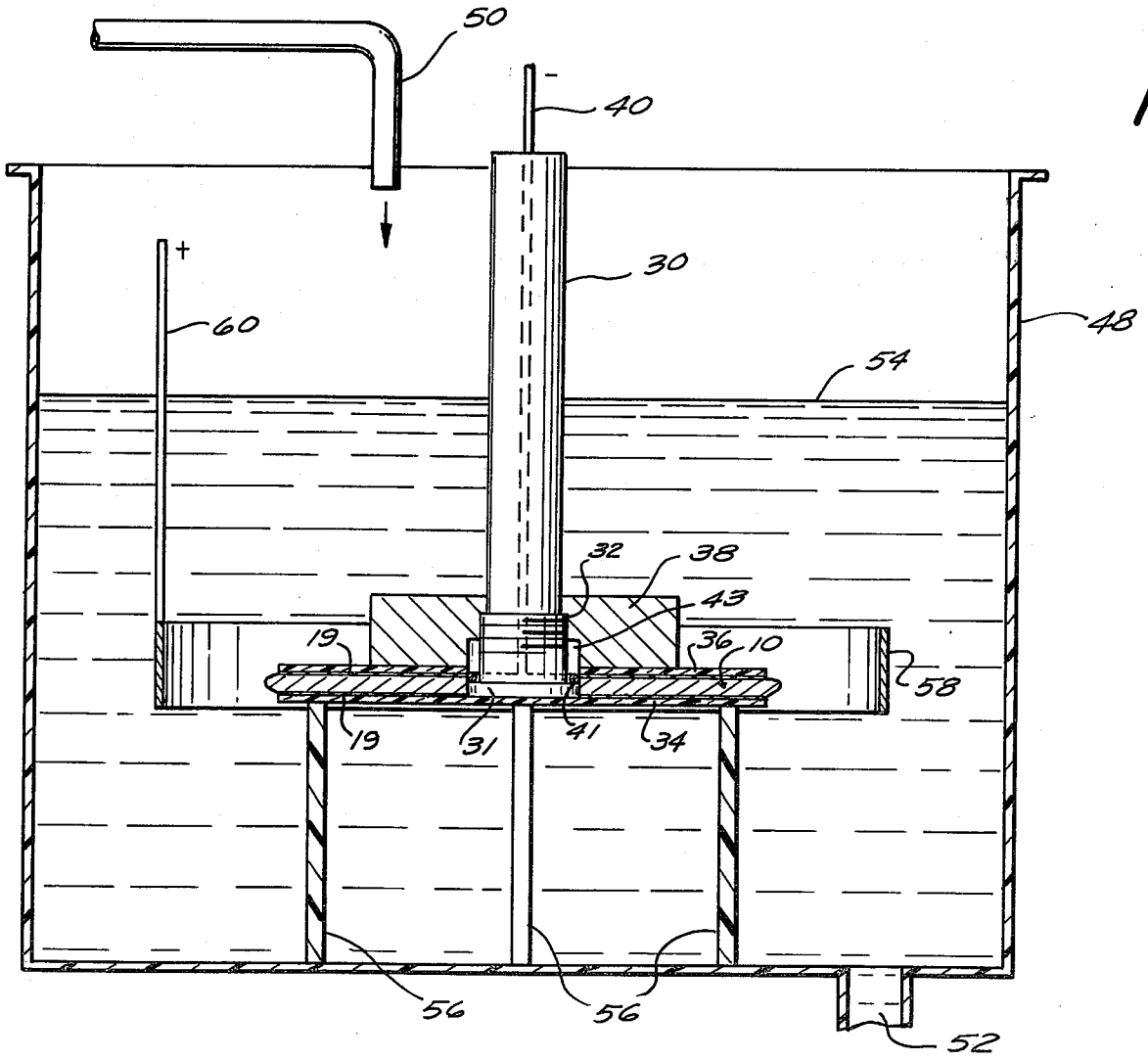
FIG. 6 is an elevational view in section of a plating tank assembly with the grinding wheel and supporting fixture therein for applying the final layer of plating material.

My improved method and apparatus for securing the abrasive particles to the working area surface in a layer of substantially uniform density and single particle thickness is illustrated in FIGS. 5 and 6. Briefly stated, a mass of abrasive particles of the above-indicated type and size is brought into contact with the working area surface of the blank and a thin coating of electroplated nickel is applied to the working surface area and to the sides of the particles in immediate contact with the surface to a height no greater than approximately ⅓ the height of the particles as shown at 16 in FIG. 3 to lightly secure or tack the particles to the surface in a layer of single particle thickness. Thereafter, the surplus unattached particles are removed and a further or final electrodeposited nickel layer is applied to the upper surface of the initial layer and to the sides of the particles to a height of between approximately ½ and ⅔ of the height of the particles as shown at 18 in FIG. 4.

Figure 2:
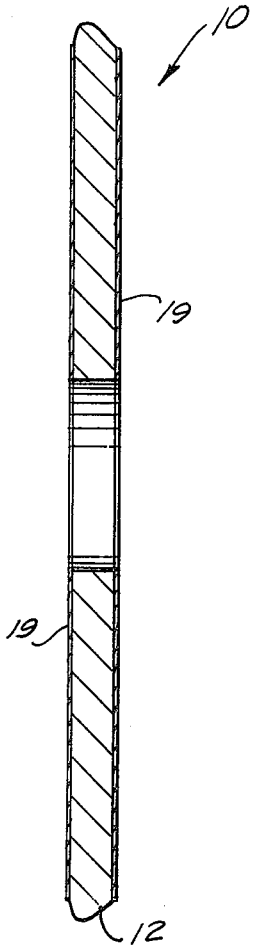
FIG. 2 is a cross-sectional view of the grinding wheel blank of FIG. 1 prior to the application of the abrasive particles to the working area surface.

The tool blank 10 shown in FIG. 2 with an uncoated working surface 12 is subjected to a standard caustic, anodic cleaning operation and then rinsed, dried and masked. In masking the blank, the sides other than the working surface are masked with a suitable masking tape resistant to the plating solution as shown at 19 in FIGS. 2, 5 and 6. For this purpose, a polyolefin, particularly a polypropyelen tape, serves very satisfactorily. The blank is then dipped in a standard pickling solution followed by washing in deionized water and drying.

The cleaned and masked tool blank is then subjected to the initial or tacking plating operation in the plating tank assembly 20 as shown in FIG. 5.

The tank itself consists of a cylindrical container made of suitable non-corrosive plastic material such as polyvinylchloride having a side wall and a base portion 22 secured thereto. The base portion has a plurality of arcuate slots extending therethrough adjacent the periphery thereof as shown at 23 and mesh screens 24 extend across these arcuate openings. The screens are of finer mesh than the abrasive particle size so as to prevent the abrasive particles inside the container from escaping through the openings.

The internal diameter of the tank is slightly larger than the outside diameter of the grinding wheel blank as shown and the lower portion of the tank wall is provided with an inwardly projecting ledge for supporting a cylindrical nickel anode 26 which fits snugly around the interior wall of the container. A suitable electric lead 28 is provided for connecting the anode to the positive side of a source of electric power.

A mandrel assembly is provided for supporting the grinding wheel blank within the container and this assembly comprises a mandrel 30 having a double stepped lower end 31 and 32 mounted on a cylindrical base portion 34. The lower end of the mandrel 31 is of a size to fit snugly in the aperture in the abrasive wheel blank and the blank is placed over the mandrel so as to rest on the base portion with its smaller diameter facing downwardly as shown in FIG. 5. The diameter of base portion 34 is substantially the same as the diameter of the face of the blank that rests thereon.

The mandrel assembly is formed of a suitable non-conductive corrosion resisting plastic material such as a polyolefin, more specifically polypropylene or polyethylene. A top disc 36 of similar plastic material and of the same diameter as the upper surface of the blank is placed over the upper surface and a locking cap 38 also made of similar plastic material is threaded to the lower portion 32 of the mandrel so as to hold the assembly in place. A conductor or lead 40 connected to the negative side of the electric power source terminates at its lower end in the resilient loop 41 of copper or similar metallic material which is of a size to tightly engage and provide electrical connection with the blank 10. The resilient loop 41 is disposed in cavity 43 provided in locking cap 38 which when the mandrel and blank are assembled is sealed against exposure to the plating solution.

The blank mounted on the mandrel assembly is inserted in the tank as shown with the anode arranged therein. Abrasive particles of the type described above are then poured into the space between the side of the tank or the anode 26 and the working area surface of the blank. The abrasive particles are compacted and brushed into place so that particles are in contact with all portions of the surface of the working area. The mass of abrasive particles rests on the base of the tank and upon the porous mesh screening closing the slotted openings 23. The conductors 28 and 40 are connected respectively to the positive and negative sides of the source of electric power and the tank assembly is then held above the plating solution level 44 in a plating tank. While thus held above the level of the plating solution, additional plating solution 54 is then poured inside the container 20 so as to flow downwardly through the abrasive particles over the working area surface and through the mesh screen into the plating tank. When the container 20 has been substantially filled, it can then be supported in the plating tank with the level of the plating solution in the container 20 maintained at a higher level than the plating solution in the plating tank so the flow of the plating solution will always be downwardly through the bed of abrasive particles. In this connection, if the plating solution is forced upwardly through the bottom of the container 20 and through the mesh screens 24, the abrasive particles will be displaced from their contacting relationship with the working area surface of the blank and this must be avoided. While the plating operation continues, additional plating solution is introduced into the container 20 through inlet pipe 46.

The initial plating operation is then continued in the container 20 until a light or tacking layer of electrodeposited nickel is applied to the working area surface of the blank and to the sides of the first layer of abrasive particles in engagement with the working area to a height of no more than approximately one third of the height of the particles.

I have found that this is adequate nickel plating to hold the abrasive particles in place until the final overplating is applied.

When the initial plating application has been completed, the container assembly can be removed from the plating tank in which it has been partially immersed as shown in FIG. 5 and the mandrel and blank assembly are then removed from the container and the surplus abrasive particles outside of the layer of single particle thickness which have been tacked to the working area surface are washed therefrom.

The final overplating can then be carried out in a plating tank such as shown at 48 in FIG. 6 having an inlet pipe 50 through which the plating solution may be introduced and an outlet 52 through which the solution may be withdrawn for filtering and recirculation. Plating solution of an adequate quantity as shown at 54 is provided in the tank and the mandrel assembly having the blank with the initial electrodeposited nickel and abrasive material on the working surface area is inserted therein so as to rest on suitable supports 56 which may be made of a corrosion resistant plastic material.

A cylindrical nickel anode somewhat larger than that provided in the initial plating container at 20 is suitably supported in the plating tank as shown at 58 and this in turn is connected by a conductor 60 to the positive side of a source of electric power with the conductor 40 being connected to the negative side of the same source. The power is turned on and the plating solution is circulated causing the further electrodeposition of nickel on the initial nickel plating layer and on the sides of the abrasive particles. This is continued until the plating engages the sides of the particles to a height of between ½ and ⅔ of the height of the particles. After the overplating is completed, the mandrel assembly having the grinding wheel mounted thereon is removed from the plating tank and washed with deionized water. The grinding wheel may then be removed from the mandrel, the masking tape stripped therefrom and after washing in tap water the grinding wheels are ready for use.

As previously stated, the electrodeposited metal is preferably nickel and accordingly the illustrated anodes 26 and 58 are made of nickel. The nickel plating solution may be a standard Watts solution. I have found that a Watts solution of the following proportions gives satisfactory results:

WATTS TYPE NICKEL PLATING BATH

Nickel Sulphate...lbs/gal...2.75

Nickel Chloride...lbs/gal...0.40

Boric Acid.....lbs/gal...0.33

Small quantities of the usual additives such as hydrogen peroxide, sodium lauryl sulphate and organic brightener compounds may also be included.

As previously explained, the initial or tacking plating is carried on until the plating reaches a height of no more than approximately ⅓ the height of the abrasive particles. Generally speaking, I have found that satisfactory results are obtained employing materials and particle sizes of the type explained above by carrying out the initial plating operation for approximately 50 minutes at 20 amps per square foot of plating area. I have also previously explained that the final overplating is carried on until the height of the plating is between ½ and ⅔ the height of the abrasive particles. I have found that satisfactory results are obtained where the overplating is carried on for approximately 3½ hours at 10 amps per square foot of plating area.

It will be seen that grinding wheels and abrasive tools can be made in improved and simplified fashion in accordance with my invention and provide a product which will perform satisfactorily over a relatively long period of time and will enable the operator to better control the tolerances, quality and quantity of the work performed by the tool.

Modifications may be made in the disclosed embodiment of the invention without departing from the invention as set forth in the accompanying claims.

I claim:

1. The method of forming an abrasive tool useful in grinding and cutting and having a working surface with a substantially single layer of abrasive particles electroplated thereon which comprises:

first providing a tool blank having a working area made of metal and presenting the required profile configuration of the tool;

preparing the metal surface of the working area for nickel plating;

supporting the blank in an enclosure presenting an impervious confining wall adjacent but spaced from the working surface of the tool blank and also presenting a porous mesh surface beneath the space between the confining wall, and working surface with the openings in the screen being smaller than the cross-sectional dimension of the hereinafter referred to abrasive particles;

arranging a compacted mass of abrasive particles in the space between the confining walls, working surface and porous screen surface, with abrasive particles in engagement with all portions of the metallic working surface;

covering the blank while supported in the enclosure with nickel plating solution and continuously passing nickel plating solution downwardly over the working surface and through the mass of abrasive particles in the presence of metallic nickel connected in an electrical circuit as an anode and with the working surface connected as a cathode until a thin coating of nickel is applied to the working surface and sides of the first layer of abrasive particles in immediate contact therewith so as to form an initial nickel plating extending for a height of no more than approximately ⅓ the height of the abrasive particles and lightly securing the first layer of abrasive particles to the working surface;

removing the surplus abrasive particles above the aforesaid first layer from the area surrounding the working surface;

and thereafter applying further nickel plating to the working surfaces and first layer of abrasive particles so as to adhere to the sides of the abrasive particles for approximately ½ to ⅔ of the height thereof to firmly secure them in place with the top surfaces of the particles being substantially free of plating and projecting above the surface of the nickel plating between the particles.

2. The method of forming an abrasive tool useful in grinding and cutting as set forth in claim 1 in which the abrasive particles are made of a material selected from natural and synthetic diamonds and borazon and are between approximately 0.005 inch and 0.009 inch in cross-sectional dimension.

3. The method of forming an abrasive tool useful in grinding and cutting as set forth in claim 1 in which the enclosure with the blank supported therein is immersed in nickel plating solution in a plating tank after the blank has been covered with plating solution with the plating solution within the enclosure being at a higher level than the plating solution in the plating tank to thereby provide a gravity head and thereafter nickel plating solution is flowed downwardly over the working surface and through the mass of abrasive particles and thence through the porous surface into the plating tank.

4. The method of making an abrasive tool which comprises:

providing a tool blank with a working area surface made of metal and having the desired profile configuration of the tool;

retaining a mass of abrasive particles in contact with the working area surface;

subjecting the working area surface and the mass of abrasive particles to an electrolyte metal plating solution in the presence of a metal anode while retaining the mass of particles in contact with the working area surface until a layer of particles of single particle thickness is lightly tacked or secured to the working area surface by an electro-deposited thin layer of metal plating applied to the working area surface and to the sides of the said particles, which layer of metal plating extends for a height of no more than approximately ⅓ the height of the abrasive particles;

then removing the surplus abrasive particles outside the said layer of single particle thickness;

and, finally, electro-depositing further metal plating on the surface of the first layer of metal plating and on the sides of the particles in said layer of single particle thickness to firmly secure them in place, which further metal plating adheres to the sides of the abrasive particles for approximately ½ to ⅔ of the height thereof.

* * * * *